US008558647B2

(12) United States Patent
Shinkai et al.

(10) Patent No.: US 8,558,647 B2
(45) Date of Patent: Oct. 15, 2013

(54) SEALING STRUCTURE OF TERMINAL MEMBER, ELECTROMAGNETIC RELAY, AND METHOD OF MANUFACTURING THE SAME

(75) Inventors: Tetsuo Shinkai, Yamaga (JP); Toshiyuki Kakimoto, Yasu (JP); Yasuyuki Masui, Kumamoto (JP); Tsukasa Yamashita, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 13/548,131

(22) Filed: Jul. 12, 2012

(65) Prior Publication Data

US 2013/0069744 A1 Mar. 21, 2013

(30) Foreign Application Priority Data

Sep. 15, 2011 (JP) ..... 2011-202138

(51) Int. Cl.
*H01H 51/22* (2006.01)

(52) U.S. Cl.
USPC ..... 335/78; 335/83

(58) Field of Classification Search
USPC ..... 335/78
See application file for complete search history.

(56) References Cited

U.S. PATENT DOCUMENTS 4,390,231 A * 6/1983 Plyler et al. ..... 439/872
5,289,144 A * 2/1994 Liao ..... 335/78
5,309,623 A * 5/1994 Okamoto et al. ..... 29/602.1
5,319,331 A * 6/1994 Hirawata et al. ..... 335/78
5,357,230 A * 10/1994 Mikawa ..... 335/78
5,359,305 A * 10/1994 Kitamura et al. ..... 335/78
5,389,905 A * 2/1995 Shibata et al. ..... 335/78
5,781,089 A * 7/1998 Doneghue ..... 335/78
5,880,654 A * 3/1999 Yamaguchi et al. ..... 335/78
5,886,601 A * 3/1999 Kitamura et al. ..... 335/129
5,889,454 A * 3/1999 Hendel ..... 335/177
5,894,253 A * 4/1999 Ichikawa et al. ..... 335/78
5,929,730 A * 7/1999 Hendel ..... 335/78
6,261,123 B1 * 7/2001 Kruger et al. ..... 439/511
6,483,407 B1 * 11/2002 Matsuda et al. ..... 335/78
6,771,154 B1 * 8/2004 Funayama et al. ..... 335/159
6,781,490 B2 * 8/2004 Funayama et al. ..... 335/78
7,283,026 B2 * 10/2007 Nakamura et al. ..... 335/78
8,305,166 B2 * 11/2012 Kojima et al. ..... 335/78
2005/0151606 A1 * 7/2005 Nishida et al. ..... 335/128

FOREIGN PATENT DOCUMENTS

JP 3213978 3/1993

* cited by examiner

*Primary Examiner* — Elvin G Enad
*Assistant Examiner* — Lisa Homza
(74) *Attorney, Agent, or Firm* — Blakely Sokoloff Taylor & Zafman

(57) ABSTRACT

Provided is a technology which has a simple structure, is easy to manufacture, and does not increase cost. A terminal member to be press-fitted into a terminal hole formed in a base, includes a press-fitted portion which is to be press-fitted in the terminal hole, and a terminal portion extending from the press-fitted portion and protruding from the base. The terminal portion is formed by folding a plate-like body such that folded portions overlap a planar portion. At least one of the folded portions has a cut-away portion extending from the base, respectively at an edge near the press-fitted portion. A sealing agent can be injected into the terminal hole via the cut-away portions.

7 Claims, 14 Drawing Sheets

SEALING STRUCTURE OF TERMINAL MEMBER, ELECTROMAGNETIC RELAY, AND METHOD OF MANUFACTURING THE SAME

BACKGROUND OF THE INVENTION

1. Technical Field

The present invention relates to a sealing structure of a terminal member, an electromagnetic relay, and a method of manufacturing the same.

2. Related Art

Conventionally, as a sealing structure of a terminal member, there is a well-known structure in which a common terminal is folded in half and it is inserted into a through-hole of a base, and the through-hole is then sealed (for example, refer to Japanese Patent No. 3213978). This terminal structure is likely to have a problem in that an air gap is formed in a bent portion of the terminal because the terminal is folded in half. Accordingly, in order to solve this problem, a line-shaped space passage is formed in the middle of the terminal and is then filled with a sealing agent beforehand.

However, in the conventional sealing structure of a terminal member, there is a problem that the structure is complicated and difficult to manufacture, which lead to an increase in cost.

SUMMARY

The present invention has been devised to solve the problems described above, and an object thereof is to provide a sealing structure of a terminal member which has a simple structure, is easy to manufacture, and does not increase cost, an electromagnetic relay, and a method of manufacturing the same.

In accordance with one aspect of the present invention, in order to achieve the above object, there is provided a sealing structure of a terminal member which is to be press-fitted into a terminal hole formed in a base, wherein the terminal member includes a press-fitted portion which is to be press-fitted into the terminal hole, and a terminal portion extending from the press-fitted portion and protruding from the base, the terminal portion is configured by folding a plate-like body such that folded portions overlap a planar portion, the folded portions have cut-away portions at edges thereof near the press-fitted portion, the cut-away portions extending from the base, and a sealing agent can be injected into the terminal hole via the cut-away portions.

According to this structure, the sealing agent can be naturally injected into the terminal hole via the cut-away portions extending from the base. Therefore, the terminal hole can be efficiently sealed and sealing performance can be enhanced. The terminal portion has a simple structure which is formed by folding a plate-like body such that the folded portions overlap a planar portion and by providing cut-away portions to the folded portions. Therefore, the terminal portion can be manufactured at low cost.

The terminal portion may be structured such that both sides of the plate-like body are folded over to overlap the planar portion, and the folded portions have the cut-away portions at their opposite sides, respectively.

According to this structure, an operation of charging the sealing agent via the cut-away portions can be performed at a border area between the planar portion and each of the folded portions, so that the terminal hole can be more smoothly sealed in a stable condition.

The cut-away portion preferably has an inclined edge that unites a portion of the cut-away portion extending from the base with the inside of the terminal hole.

This structure allows the sealing agent being injected into the terminal hole via the cut-away portions to smoothly flow over a short distance along the inclined edge.

The cut-away portions are preferably formed by cutting away opposing sides of both the folded portions in a portion extending from the base so that the cut-away portions and the planar portion form a sealing agent reservoir.

This structure allows a surplus sealing agent, which cannot be retained in the terminal hole and thus overflows, to be solidified in the sealing agent reservoir, so that the surplus sealing agent is prevented from negatively affecting other portions.

Among portions of each of the cut-away portions, portions which form the sealing agent reservoir may be formed to be broader than the other portions.

This structure increases flow-resistance of the sealing agent at locations other than the terminal hole, so that the flow of the sealing agent to the other locations can be reliably stopped.

The terminal member preferably includes a contact piece portion protruding from a side of the base opposite to a side from which the terminal portion protrudes. The contact piece is elastically deformable and has a contact at a leading end thereof.

According to this structure, the plate-like body is used in its original form at the contact piece portion and is folded at the terminal portion so that desired thickness and strength can be obtained.

In accordance with another aspect of the present invention, in order to achieve the above object, there is provided an electromagnetic relay with a fixed contact piece which has any of the above-mentioned structures.

According to the present invention, a terminal portion includes a planar portion and folded portions which are folded from both sides of a plate-like body so as to overlap the planer portion, in which the folded portions has cut-away portions extending from a base. Accordingly, the terminal portion has a simple structure and can be manufactured at low cost. Moreover, a sealing agent can be effectively injected into a terminal hole via the cut-away portions so that the sealing performance can be significantly enhanced.

DETAILED DESCRIPTION

Figure 1:
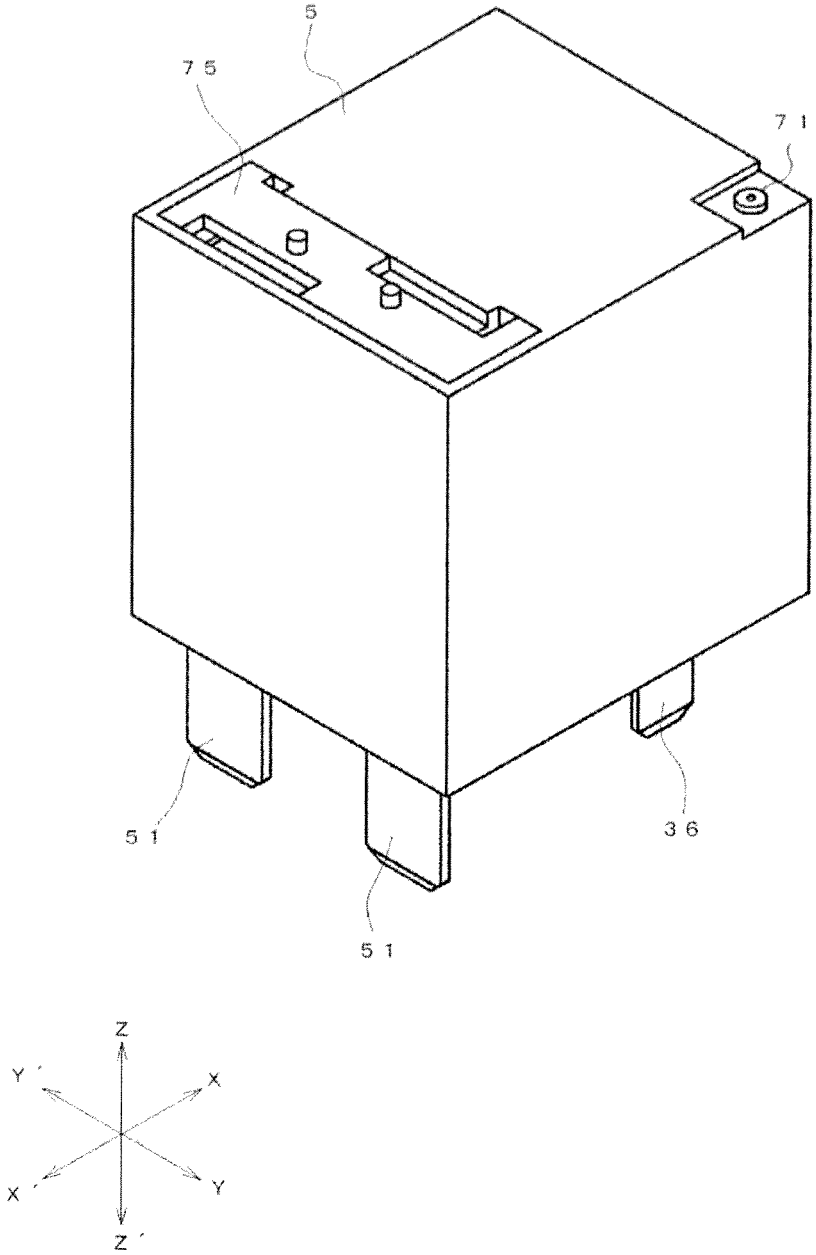
FIG. 1 is a perspective view illustrating an electromagnetic relay according to an embodiment of the present invention.

Hereinafter, preferred embodiments of the present invention will be described with reference to the drawings. Note that in the description below, terms that refer to specific directions and positions (for example, terms including "upper", "lower", "side", and "end") are used if necessary. The purpose of using those terms is to help better understand the present invention referring to the drawings, but the technical scope of the present invention should not be limited by meanings of those terms. The description made hereinbelow represents just an essential example of the present invention and is not intended to limit the present invention, applications of the present invention, and uses of the present invention.

1. Overall Structure

FIGS. 1 to 5 illustrate an electromagnetic relay according to an embodiment of the present invention. Briefly, as for this electromagnetic relay, an electromagnet block 2, a contact switching unit 3, and a movable iron piece 4 are installed on a base 1, and the whole structure is encased in a case 5.

1-1. Base 1

Figure 6A:
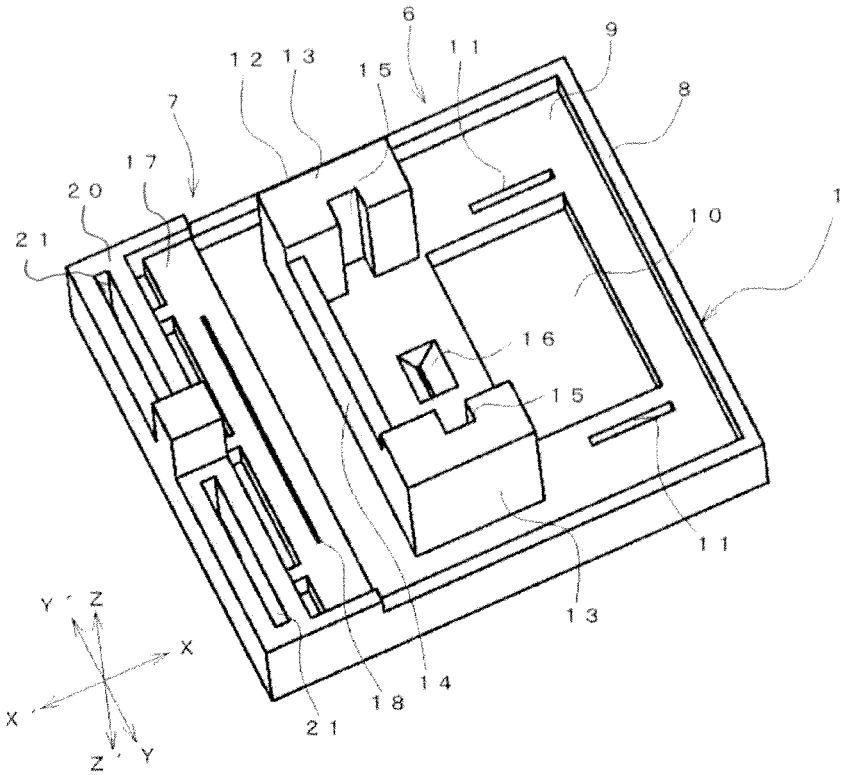
FIG. 6A is a perspective view illustrating a base viewed from above and FIG. 6B is a perspective view illustrating the base viewed from below.
Figure 6B:
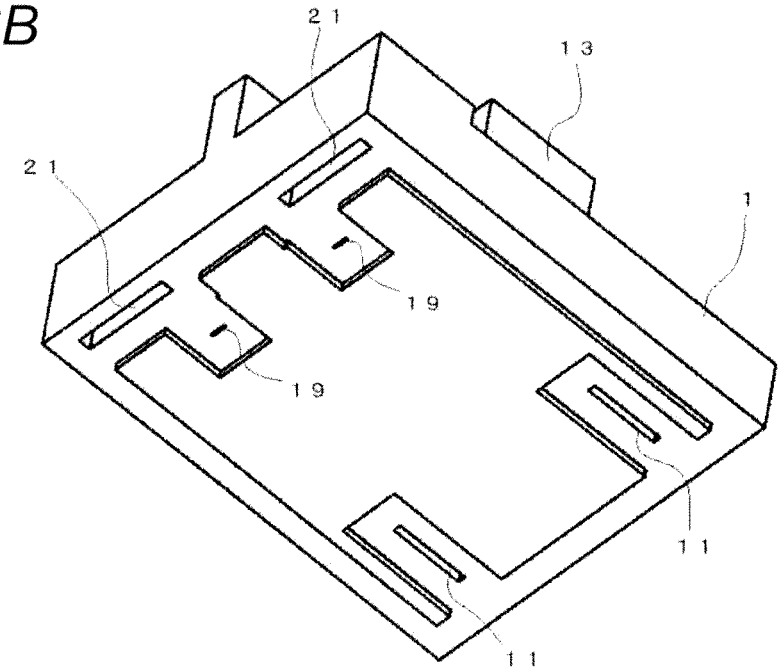

The base 1 is rectangular in a plan view and is formed by performing a molding process with a synthetic resin material as shown in FIGS. 6A and 6B. In the base 1, there are two installation areas including a first installation portion 6 and a second installation portion 7 arranged in a longitudinal direction. Hereafter, the longitudinal direction running along a longer side is referred to as X-axis, a lateral direction running along a shorter side is referred to as Y-axis, and a direction running along the height is referred to as Z-axis.

The first installation portion 6 is an area reserved for installation of the electromagnet block 2 to be described later and is configured in a manner that a supporting concave portion 10 is formed in a recess 9 surrounded with a first periphery wall 8 formed on an upper surface of the base 1 and with a second installation portion 7. In the bottom of the recess 9, a pair of coil terminal holes 11 that completely pass through the bottom of the recess 9 from the upper side to the lower side are formed at both sides of the supporting concave portion 10 in the lateral direction of the base 1 (the direction of YY'), respectively. In a lower surface of the base 1, concave sealing portions, each with four tapered side surfaces, are formed such that each concave sealing portion is formed in a surrounding area of a location where the coil terminal hole 11 is open.

A guide portion 12 is formed near the supporting concave portion 10 (in the longitudinal direction of the base 1). The guide portion 12 includes a pair of guide walls 13 which are formed to correspond to the shorter-side direction (the direction of YY'), and an insulation wall 14 that connects the pair of guide walls 13. Guide grooves 15 each of which vertically extends are formed in opposing surfaces of the guide walls 13, respectively. Both sides of a yoke 41 to be described later are guided by both the guide grooves 15. Moreover, a concave guide portion 16 is formed at a center portion of an area surrounded with the guide walls 13 and the insulation wall 14. A to-be-guided portion 50 of a hinge spring 44 to be described later is located in the concave guide portion 16.

Figure 14:
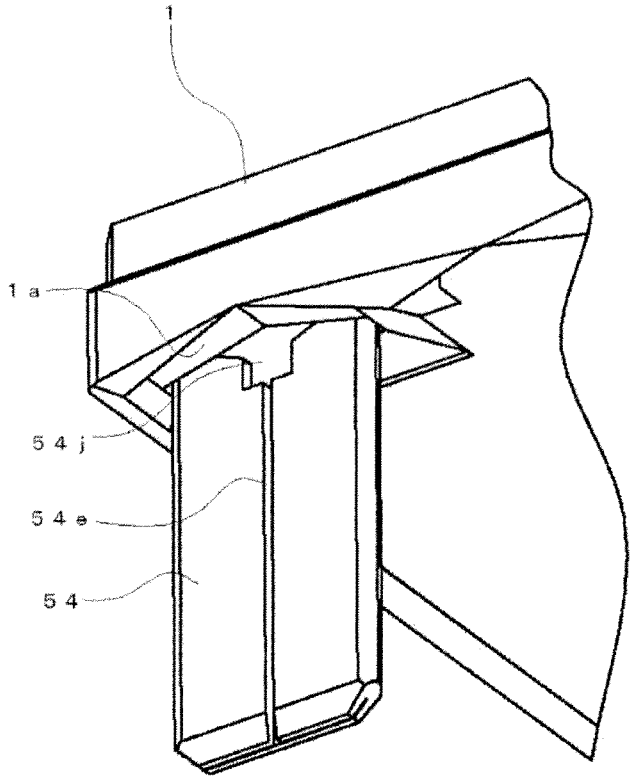
FIG. 14 is an enlarged partial perspective view illustrating a portion of a base of FIG. 3, in which a fixed contact piece is installed, when viewed from the bottom surface side.

The second installation portion 7 is an area reserved for the contact switching unit 3, and a plinth 17 having the same height as the first periphery wall 8 of the first installation portion 6 is formed in the second installation portion 7. In the plinth 17, a slit-like first terminal hole 18 extending in the direction of YY' is formed. The first terminal hole 18 passes through the bottom of the base 1 only at two locations where communicating portions 19 are formed, and a movable contact piece 52 to be described later is press-fitted into the first terminal hole 18. A second periphery wall 20 is formed at three sides of the plinth 17 except for one side that is near the first installation portion. A part of the second periphery wall 20 which is disposed on the side of the X' direction side is relatively thick and has a pair of slit-like second terminal holes 21 which extend and are arranged in the direction of YY'. Each second terminal hole 21 is formed by opening the bottom surface of the concave portion which is formed in the upper surface of the base 1 while leaving a middle portion of the bottom surface of the concave portion. When fixed contact pieces 51 to be described later are press-fitted into the respective second terminal holes 21 so as to be fixed, a lower edge of the press-fitted portion 53 comes in contact with the bottom surface so that positioning at insertion positions is achieved. Each of the second terminal holes 21 is located near the short side of the base 1 in the X' direction, and a distance between the opening in the lower surface and the shorter side is small. Moreover, as illustrated in FIG. 14, a recess 1 a extending from the position of the opening of each second terminal hole 21 to the short side of the base 1 is formed in the lower surface of the base 1. The bottom surface of the recess 1*a* is tapered like a mountain, that is, the recess 1*a* is deepest at the center thereof.

1-2. Electromagnet Block 2

Figure 7:
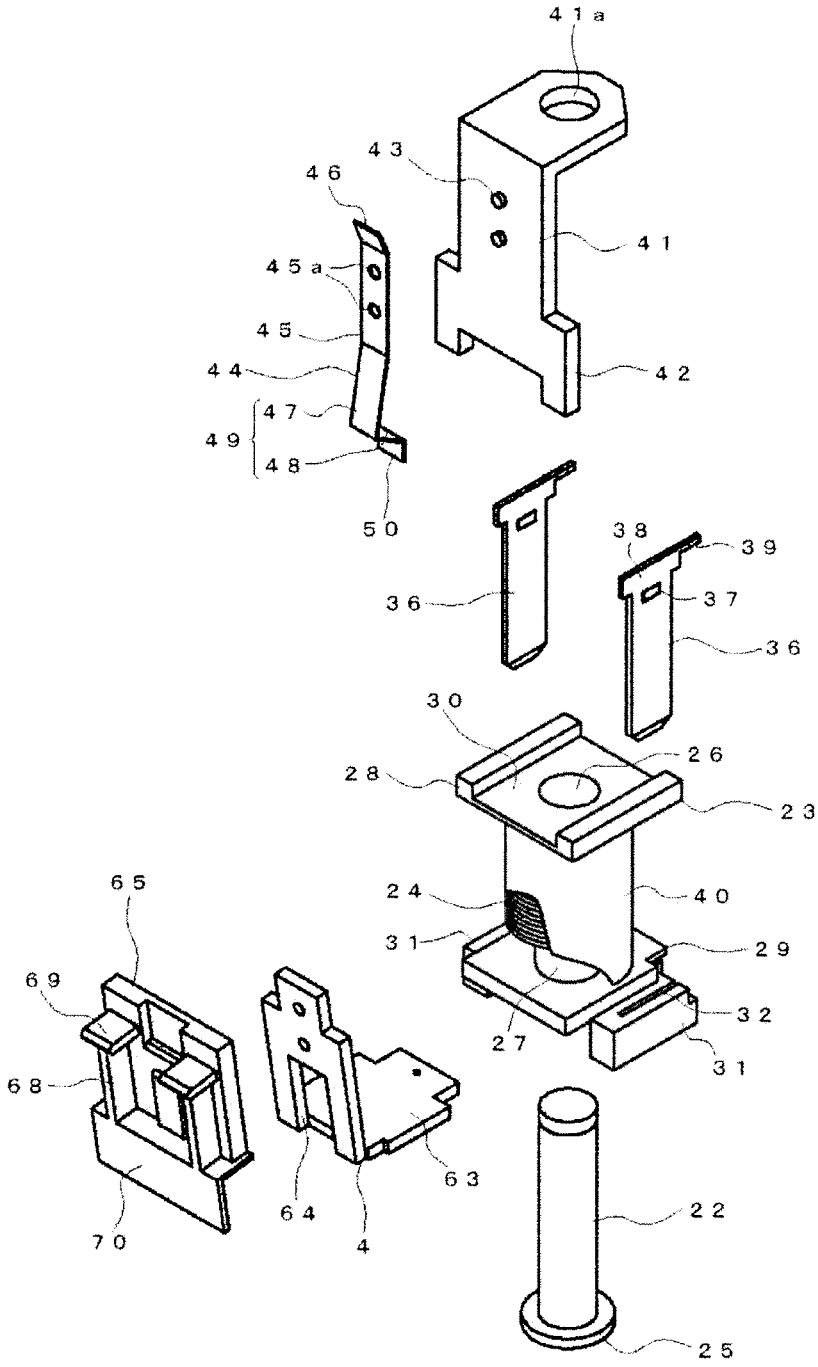
FIG. 7 is an exploded perspective view of an electromagnet block and a movable iron piece shown in FIG. 2.
Figure 8:
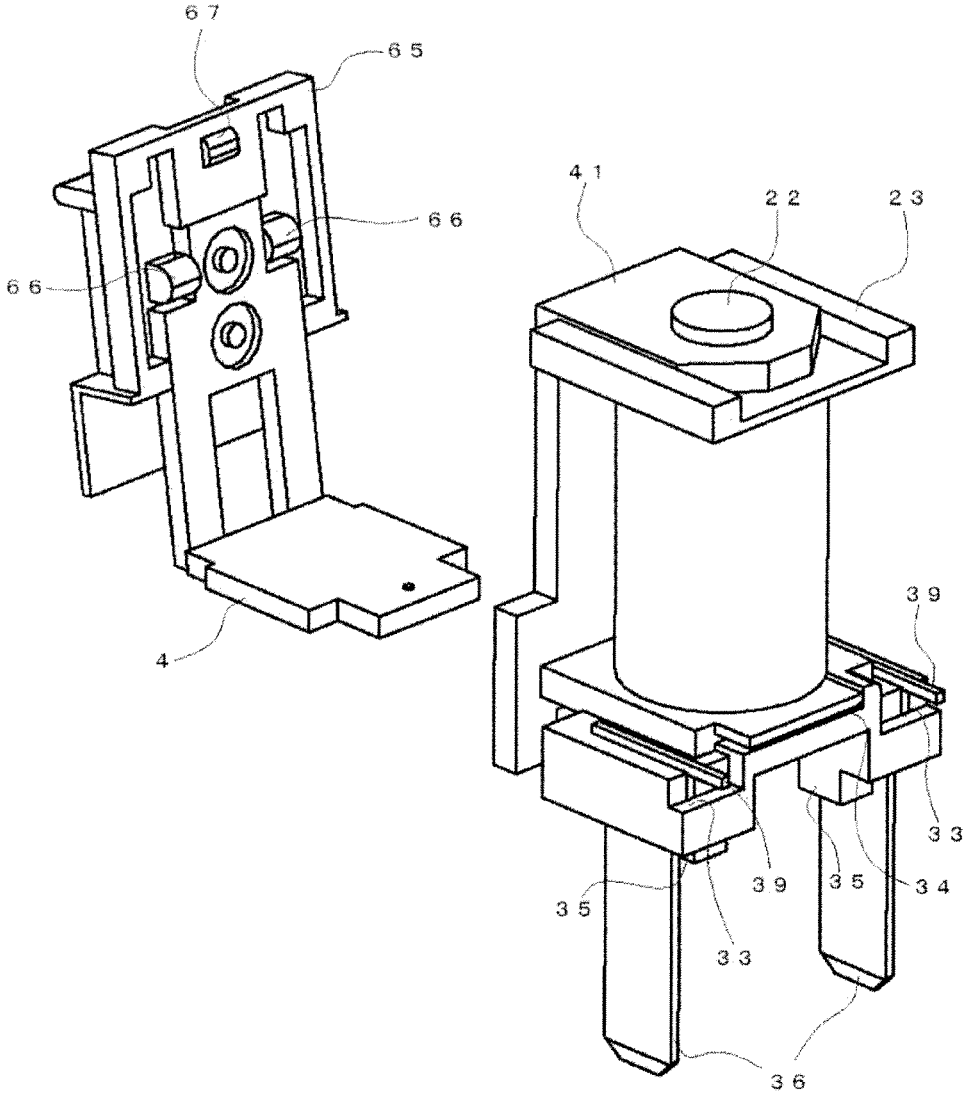
FIG. 8 is an exploded perspective view of the electromagnet block and the movable iron piece shown in FIG. 2.

As illustrated in FIGS. 7 and 8, the electromagnet block 2 is a structure formed by winding a coil 24 around an iron core 22 using a spool 23.

The iron core 22 is a bar of an electromagnetic material. As for the iron core 22, a flange-like magnetic pole portion 25 is formed at a lower end of the iron core 22 and the yoke 41 is fastened to an upper end of the iron core 22.

The spool 23 is obtained by performing a molding process with a synthetic resin material, and includes a cylindrical trunk 27 having a center hole 26 formed therein and flanges (an upper-end flange 28 and a lower-end flange 29) formed at an upper end and a lower end of the cylindrical trunk 27, respectively.

In an upper surface of the upper-end flange 28, a relief groove 30 is formed and the center hole 26 is open. An end of the yoke 41 to be described later is disposed in the relief groove 30. The center hole 26 is also open in the lower-end flange 29 and the iron core 22 can be inserted into the center hole 26 from the lower-end flange 29.

Terminal attachment portions 31 are provided at both sides of the lower-end flange 29, respectively and terminal holding holes 32 are formed there, respectively. Coil terminals 36 to be described later are press-fitted in and fixed to the terminal holding holes 32, respectively. Step portions 33 are formed on both sides of an end of the terminal attachment portion 31, respectively, and coil winding portions 39 of the coil terminals 36 which are press-fitted in the terminal holding holes 32 to be fixed project over the step portions 33, respectively. Moreover, the lower-end flange 29 has a guide groove 34 that communicates with one of the step portions 33 via a way from the trunk 27 to a side end surface thereof. An end of the coil 24 (a beginning end of turns of the coil 24) wound around the trunk 27 is disposed in the guide groove 34, and the coil 24 is wound around the coil winding portion 39 of the coil terminal 36 which projects over the step portion 33. A pair of guide protrusions 35 are provided in the bottom surface of the lower-end flange 29 at a predetermined interval. The guide protrusions 35 serve to position the spool 23, in other words, the electromagnet block 2 with respect to the base 1 by being put in the supporting concave portions 10 of the base 1.

The coil terminal 36 is a plate-like body of an electrically conductive material, and its lower end portion is tapered to the bottom such that the width and thickness are gradually decreased toward the bottom. The coil terminal 36 has a press-fitted portion 37 which is expanded from one surface of the plate-like body through a press-working process at an upper end portion thereof, and a portion of the coil terminal 36 on the upper side of the press-fitted portion 37 is formed as a wide width portion 38. The coil winding portion 39 projects from one end of the wide width portion 38.

The coil 24 is wound around the trunk 27 of the spool 23, and an insulation sheet 40 is attached to the outer circumferential surface of the coil 24. One end of the coil 24 is arranged in the guide groove 34 of the spool 23, and the coil 24 is then wound around the trunk 27 of the spool 23. After that, both ends of the coil 24 are wound around the coil winding portion 39 of the coil terminal 36, and then soldered to be fixed.

The yoke 41 is fastened to an end of the iron core 22.

The yoke 41 is made of a magnetic material and has a bent body of a substantial L shape. An end of the yoke 41 is provided with an opening 41*a* so that an end of the iron core 22 is inserted in the opening 41*a* so as to be fastened to the end of the yoke 41. The other end of the yoke 41 is a wide width portion, and protruding portions 42 are provided at both sides of a lower end of the wide width portion, respectively. The movable iron piece 4 to be described later is located between both the protruding portions 42, and one corner of the protruding portions 42 functions as a fulcrum on which the movable iron piece 4 is movably supported. In a middle portion of the yoke 41, two fastening projections 43 are formed on an outside surface of the yoke 41 and they are arranged on a vertical line.

A hinge spring 44 is fastened to the middle portion of the yoke 41 by using the projections 43. However, the method of fixing the hinge spring 44 to the yoke 41 is not limited to the fastening, but a different method such as ultrasonic welding, resistance welding, laser welding, or the like may be used.

The hinge spring 44 includes a joint portion 45 that comes in contact with the outside surface of the middle portion of the yoke 41. The joint portion 45 has through-holes 45*a* at two locations and the projections 43 of the yoke 41 are inserted into the through-holes 45 so as to be fastened.

The upper side of the joint portion 45 is an elastic contact portion 46 which extends at a predetermined angle as if the elastic contact portion 46 gradually becomes farther from the outside surface of the middle portion of the yoke 41. The elastic contact portion 46 is configured to be able to come in contact with a pressing force receiving portion of a card member 65 provided to the movable iron piece 4 to be described later. The elastic contact portion 46 alleviates collision noise generated when the movable iron piece 4 returns to a default position.

The lower side of the joint portion 45 is an elastic support portion 49 which includes a first inclination portion 47 extending at a predetermined angle as if it gradually becomes farther from the outside surface of the middle portion of the yoke 41 and a second inclination portion 48 extending from the first inclination portion 47 at a predetermined angle as if it gradually becomes closer to yoke 41. The second inclination portion 48 of the elastic support portion 49 is in pressure-contact with the movable iron piece 4 to be described later so that the movable iron piece 4 is elastically, turnably supported on the elastic support portion 49.

The lower side of the elastic support portion 49 serves as the to-be-guided portion 50 which extends downward in a vertical direction in a state in which the movable iron piece 4 is elastically supported on the elastic support portion 49. The to-be-guided portion 50 is arranged in the concave guide portion 16 formed in the first installation portion 6 of the base 1 and guided by the concave guide portion 16 so that the hinge spring 44 is prevented from being mispositioned.

1-3. Contact Switching Unit 3

Figure 4:
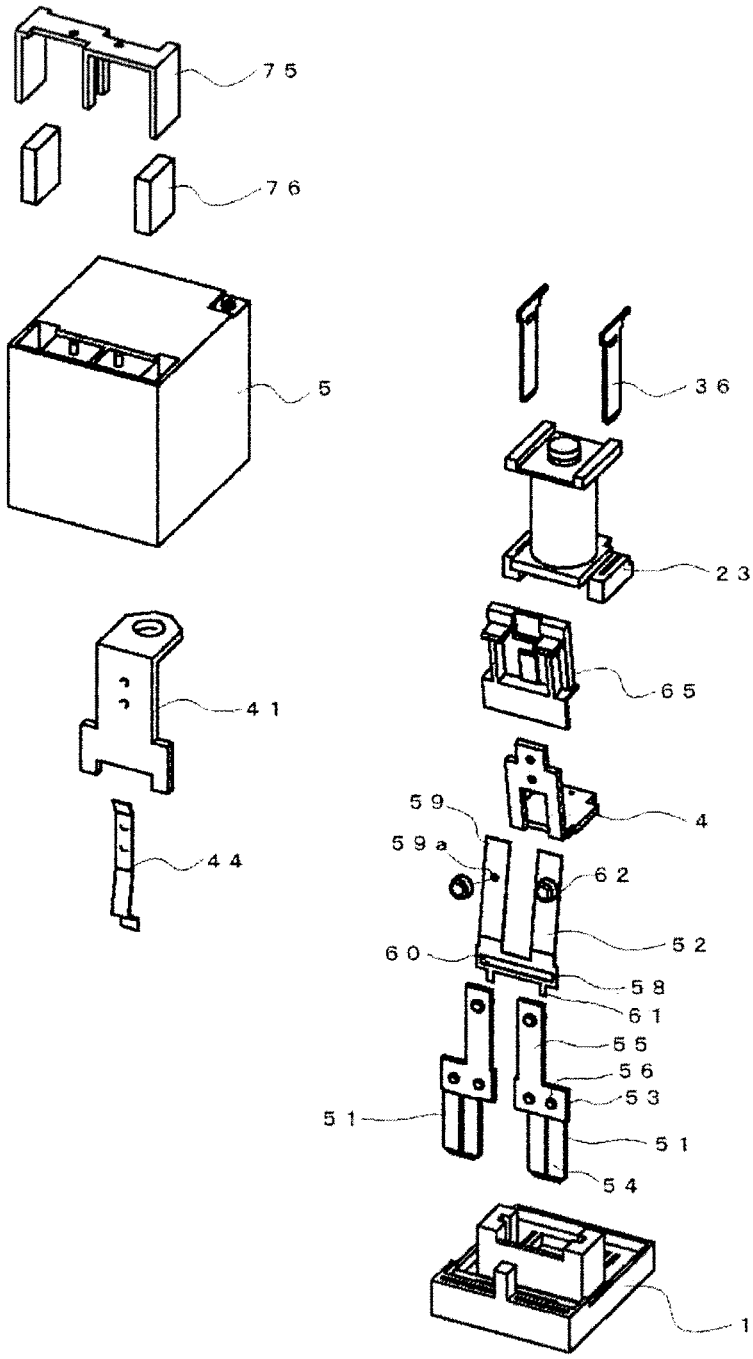
FIG. 4 is an exploded perspective view of the structure of FIG. 1.
Figure 5:
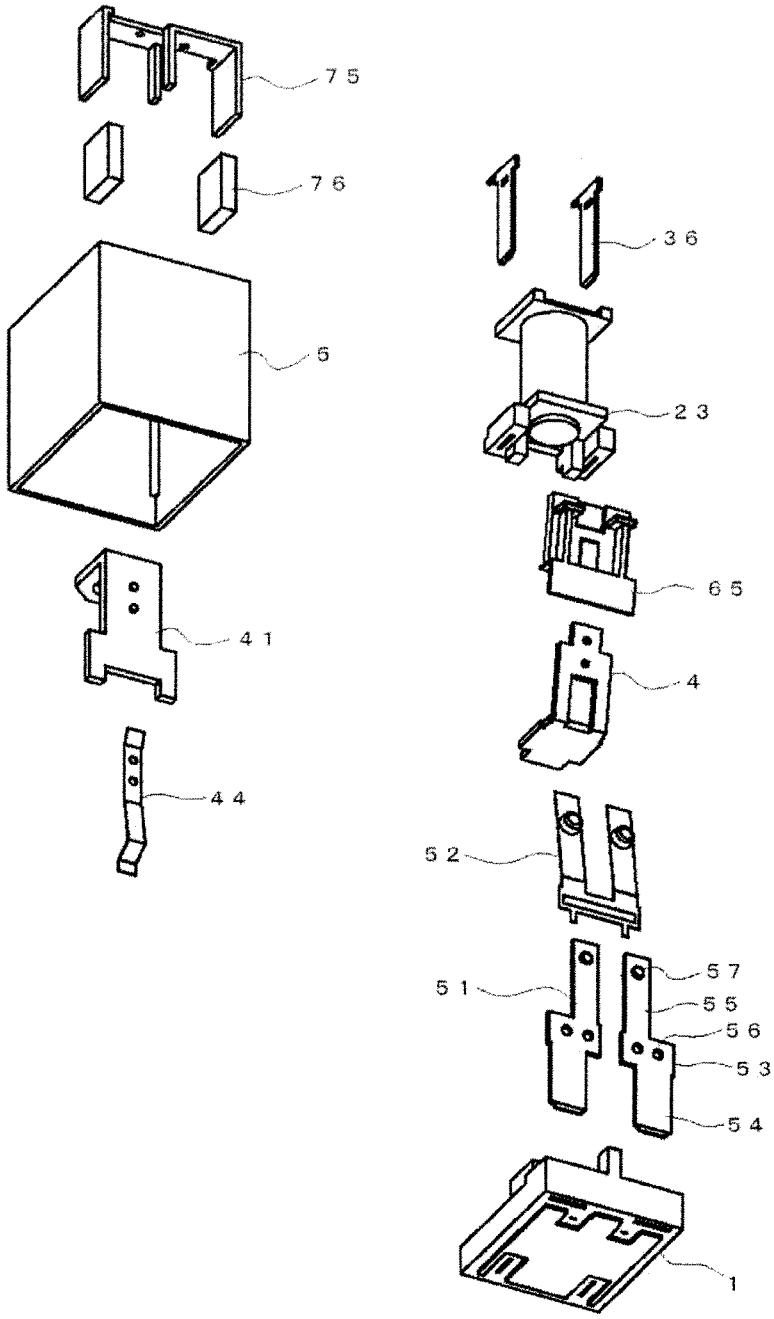
FIG. 5 is an exploded perspective view illustrating the state of FIG. 4 viewed from the opposite side.

The contact switching unit 3, as illustrated in FIGS. 4 and 5, includes the fixed contact pieces 51 and the movable contact piece 52, each of which is obtained by performing press working on an electrically conductive material such as copper.

The fixed contact piece 51 is an example of the terminal member with the sealing structure according to the present invention, and includes a press-fitted portion 53, a terminal portion 54 extending downward from the press-fitted portion 53, and a contact piece portion 55 extending upward from the press-fitted portion 53.

The press-fitted portion 53 is provided with expansion portions 56 that are expanded from one surface thereof by using the press working process. The press-fitted portion 53 can be press-fitted into the second terminal hole 21 of the base 1 by using the this expansion portions 56.

Figure 13A:
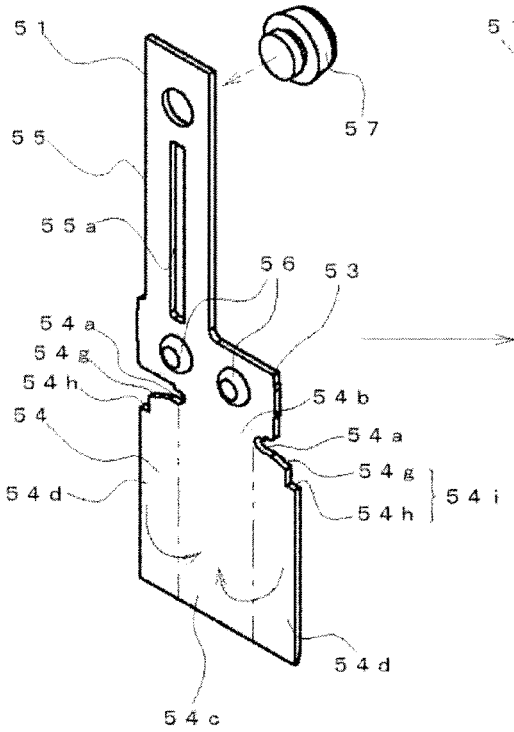
FIG. 13A is a perspective view illustrating a state before processing a fixed contact piece and FIG. 13B is a perspective view illustrating a state after processing the fixed contact piece.
Figure 13B:
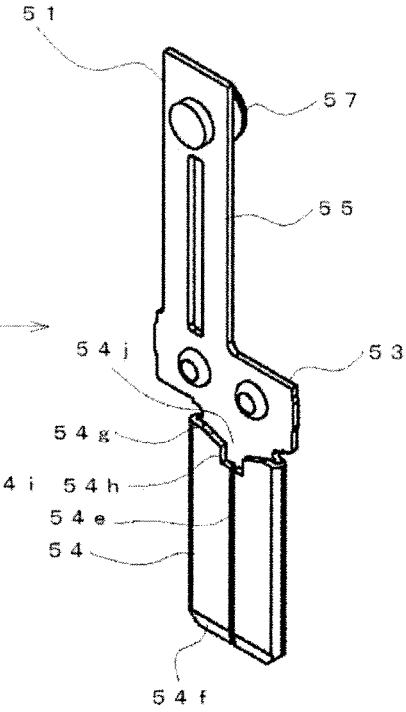

The terminal portion 54 is formed by changing a flat panel of an almost rectangular shape connected to a narrow width portion 54*b* which is formed by arc-shaped notch portions 54*a* formed at both sides thereof as shown in FIG. 13A into a plate shape shown FIG. 13B by folding over both sides of the almost rectangular flat panel. That is, the terminal portion 54 is a plate-like body including a planar portion 54*c* connected to the press-fitted portion 53 and folded portions 54*d* that are folded over to overlap the planar portion 54*c*. The plate-like terminal portion 54 has a smaller width than the press-fitted portion 53 and is deviated from the centerline. Moreover, the terminal portion 54 has a thickness about two times that of the contact piece portion 55 so that enough strength can be secured. Moreover, the notch portions 54*a* facilitate folding of the folded portions 54*d*.

In the middle portion of the terminal portion 54, a predetermined gap extending in the longitudinal direction exists between the folded portions 54*d* so that a groove 54*e* is formed by the folded portions 54*d* and the planar portion 54*c*. Moreover, at leading end portions of the folded portions 54*d* and the planar portion 54*c*, opposite outside surfaces gradually become closer to their respective overlapping surfaces such that the plate thickness is decreased toward a leading edge. The leading end portions function as an insertion portion 54*f*. An upper end portion of each of the folded portions 54*d* has a cut-away portion 54*i* consisting of an inclined edge 54*g* and an L-shaped edge 54*h*, in which the inclined edge gradually slops toward the middle portion of the terminal portion with respect to the leading end portion and the L-shaped edge 54*h* is disposed near the groove 54*e*. Then, a lower edge of the press-fitted portion 53 comes in contact with the bottom of the second terminal hole 21 of the base 1 in a state in which the terminal portion 54 is press-fitted into the base 1, so that the terminal portion 54 is not further press-inserted thereafter. As a result, as for the terminal portion 54, the portions extending from the lower surface of the base 1 include the L-shaped edge 54*h* and part of the inclined edge 54*g* of the cut-away portion 54*i*. At a location where both the folded portions 54*d* face each other, a sealing agent reservoir 54*j* is formed by the surface of the planar portion 54*c* and the L-shaped edges 54*h*, so that the sealing agent is prevented from flowing to the leading end portion of the terminal portion 54.

The contact piece portion 55 is formed on the opposite side of the terminal portion 54 and misaligned with the terminal portion 54. Since the terminal portion has an overlappingly folded structure, the contact piece portion is allowed to have such a small thickness that enables the contact piece portion to be elastically deformed. A middle portion of the contact piece portion 55 is provided with a slit 55*a* and an upper end portion of the contact piece portion 55 is provided with a through-hole in which the fixed contact 57 is fastened.

The movable contact piece 52 includes a press-fitted portion 58 and a pair of contact piece portions 59 extending upward from both sides of the press-fitted portion 58, respectively. At a center portion of the press-fitted portion 58 in the vertical direction, an expansion portion 60 extending in the widthwise direction is formed like in the fixed contact piece 51. The expansion portion 60 can be press-fitted into the first terminal hole 18 of the base 1. Moreover, a pair of projections 61 that project downward are respectively formed at both ends of a lower edge of the press-fitted portion 58. The contact piece portion 59 is bent at a location near the press-fitted portion 58 and has a through-hole 59*a* at an upper end portion thereof, and the movable contact 62 is fastened by the through-hole 59*a*. The movable contact piece 52 is arranged such that the movable contact 62 can move closer to and away from the fixed contact 57 of the fixed contact piece 51 which is press-fitted into the second terminal hole 21 in a state in which the press-fitted portion 58 is press-fitted into the first terminal hole 18 of the base 1.

1-4. Movable Iron Piece 4

The movable iron piece 4 is formed by performing press working on a plate of a magnetic material so that the plate becomes an L shape as shown in FIGS. 7 and 8. An end portion of the movable iron piece 4 is a to-be-attracted portion 63 which is to be attracted to the magnetic pole portion 25 of the iron core 22. A leading end portion and a base portion of the to-be-attracted portion 63 has a small width, so that an interference between the protruding portions 42 formed in the lower end portion of the yoke 41 and the guide protrusion 35 formed in the bottom surface of the spool 23 can be avoided. The other end portion of the movable iron piece 4 is provided with an opening 64. The hinge spring 44 passes through the opening 64, and comes in pressure-contact with a corner portion of the to-be-attracted portion 63. The other end portion of the movable iron piece 4 has a small width, and the card member 65 is integrally formed with an upper portion of the movable iron piece 4 which is disposed on the upper side of the opening 64.

The card member 65 is made of a synthetic resin material. On one surface of the card member 65 from which the upper end portion of the movable iron piece 4 which is integrally formed with the card member 65 is exposed, first protruding portions 66 are formed at both sides of the upper end portion of the movable iron piece 4, respectively and a second protruding portion 67 is formed at an upper side of the first protruding portions 66. When the to-be attracted portion 63 of the movable iron piece 4 is separated from the magnet pole portion 25 of the iron core 22, the elastic contact portion 46 of the hinge spring 44 collides with the second protruding portion 67, and after which the first protruding portion 66 comes into contact with the yoke 41. On the other surface of the card member 65, projection portions 68 extending in the vertical direction are formed at a predetermined interval in the widthwise direction. Pressing portions 69 which project more than the projection portions 68 are formed at upper ends of the projection portions 68, respectively so that the pressing portions 69 can press the upper ends of the contact piece portion 59 of the movable contact piece 52. A shield wall 70 which protrudes more than the other surface and extends downward is formed at a lower end portion of the card member 65.

1-5. Case 5

Figure 2:
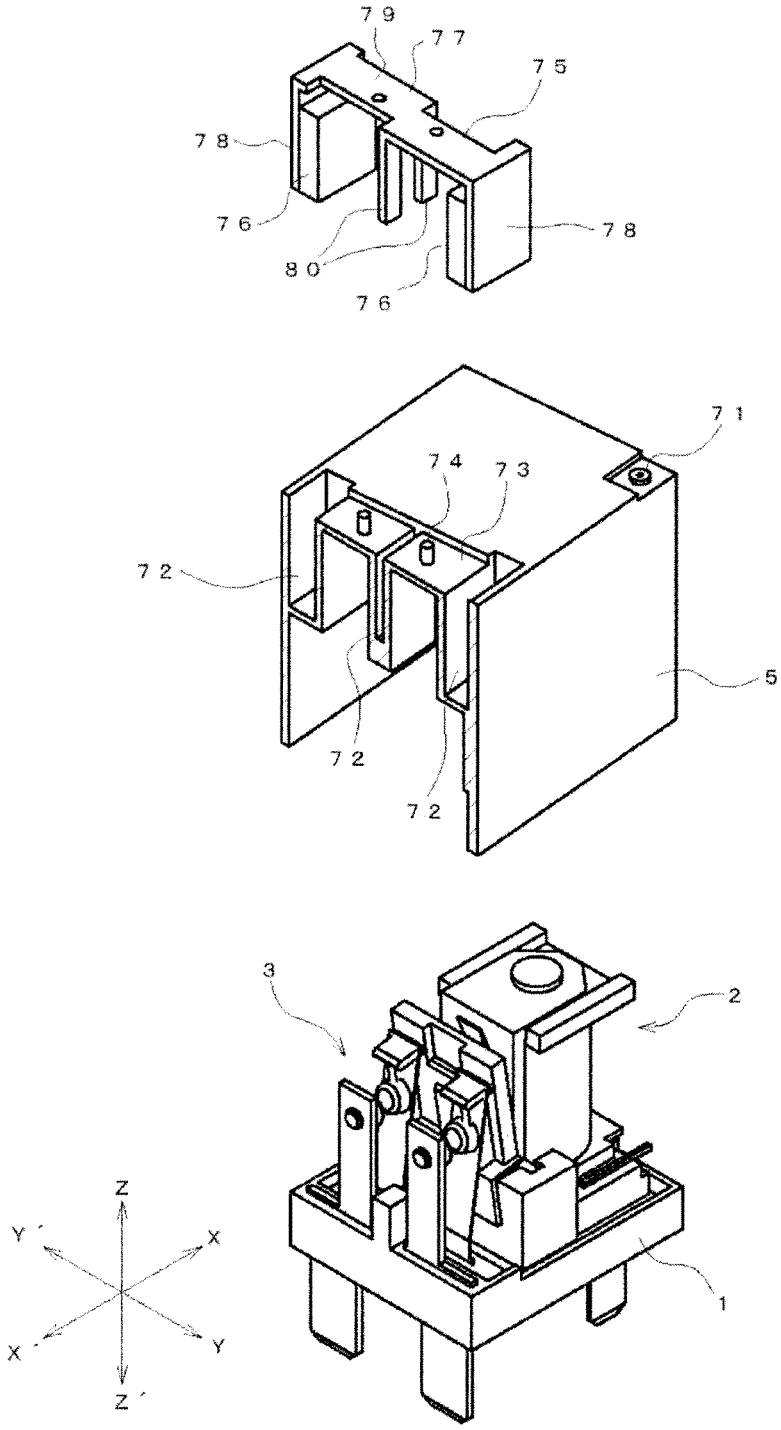
FIG. 2 is a perspective view illustrating a state in which the structure of FIG. 1 is disassembled so that a case and an arc-extinguishing member are separated from each other.
Figure 3:
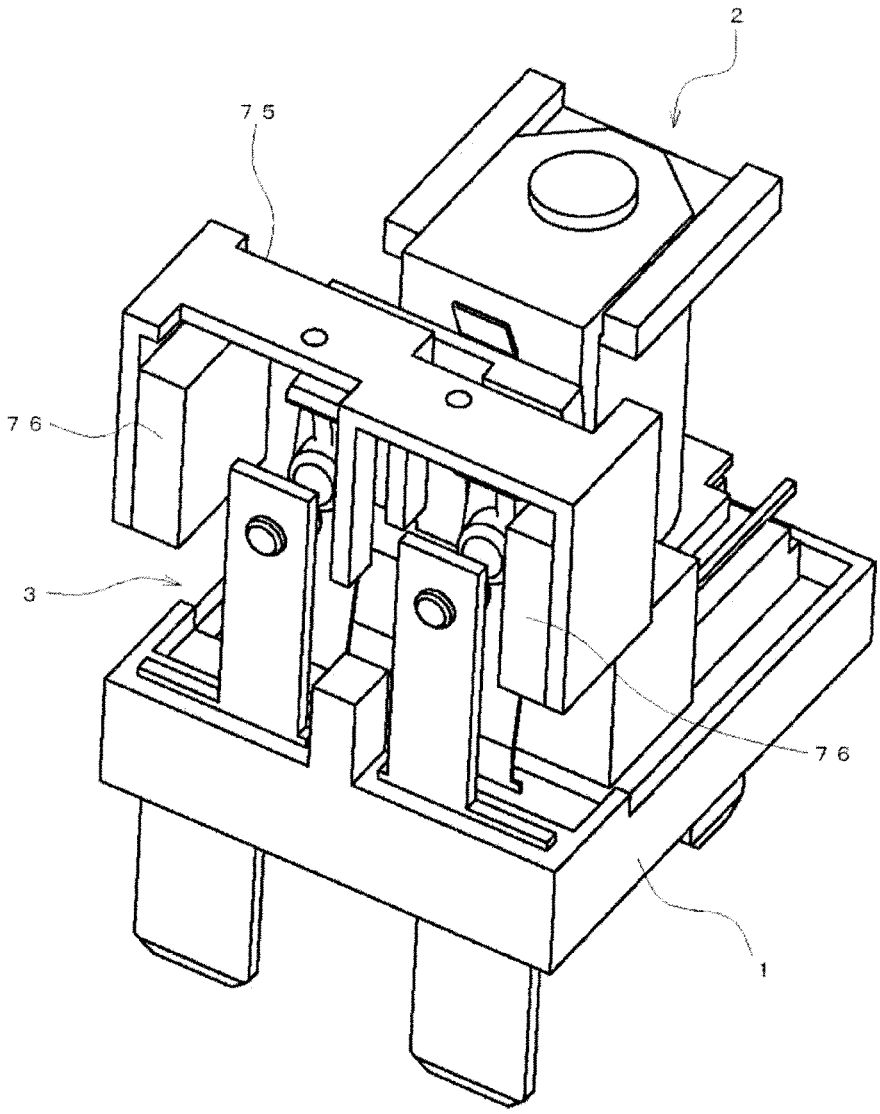
FIG. 3 is a perspective view illustrating a state in which only the case is removed from the structure of FIG. 1.

The case 5 has a box shape which is open at a lower end as shown in FIG. 2 and is made of a synthetic resin material. The case 5 has a sealing hole 71 in a corner of an upper surface. After a fitting portion of the base 1 and the case 5 is sealed, the sealing hole 71 is closed by heat sealing. At an edge of the upper surface of the case 5 on the opposite side of the sealing hole 71, slit-like concave portions 72 are formed at both side portions and a center portion, respectively. A recess 73 that is recessed from the upper surface of the case 5 is formed every between the concave portions 72, and a projection 74 is formed at a center portion of the surface of the recess 73.

An arc-extinguishing member 75 is attached to the case 5 using the concave portions 72 and the recess 73.

The arc-extinguishing member 75 includes a pair of permanent magnets 76, arranged at a predetermined interval, for extinguishing the arc and a joint member 77, made of a magnetic material, for magnetically connecting these permanent magnets 76.

The permanent magnets 76 have an almost rectangular parallelepiped shape and are arranged such that opposite sides thereof may have different polarities in a state in which the permanent magnets 76 are attached to the opposite inside walls 78 of the joint member 77. However, the polarities of the opposing surfaces may be set such that the direction of force exerting on the arc current which changes according to the direction of the current flowing at a contact point is directed toward a middle wall 79 of the joint member 77 to be described later.

The joint member 77 is formed by performing press working on a plate of a magnetic material such that both ends are bent so as to face each other. The permanent magnets 76 are attracted and fixed to the inside surfaces of the opposing walls 78, respectively. In the middle wall 79 of the joint member 77, both side portions of the middle wall 79 are cut away at different locations which are nearer opposite ends, respectively, so that middle protruding portions 80 are formed between the opposing walls 78. Each of the middle protruding portions 80 serves to shorten a magnetic path by being located in the middle portion between both the opposing walls 78 and protruding between both contact switching positions. That is, in a magnetic circuit, a closed loop is formed such that the magnetic flux generated from each of the permanent magnets 76 passes the middle wall 79 and each of the opposing walls 78 via the middle protruding portions 80, and returns to the permanent magnets 76.

As described above, the arc-extinguishing member 75 is provided with not only the pair of permanent magnets 76 but also the joint member 77 to magnetically connect the permanent magnets 76. Therefore, the magnetic circuit is formed, and as a result, it becomes difficult for the magnetic flux to leak. Moreover, since the middle protruding portions 80 are provided, the magnetic path can be shortened. Therefore, magnetic efficiency can be improved. Accordingly, even if an arc occurs at the time when the contact is opened or closed, this arc elongates to the sides according to the Fleming's left hand rule, and as a result, the arc is extinguished in a short time.

2. Assembling Method

Next, a method of assembling a magnetic relay having the structure described above is described.

The coil 24 is wound around the trunk 27 of the spool 23, and the coil terminal 36 is press-fitted and fixed to the lower-end flange 29. Both ends of the coil 24 are wound around the coil winding portion 39 and soldered. Moreover, the iron core 22 is inserted to pass through the center hole 26 of the spool 23 from the lower end of the spool 23, and the yoke 41 to which the hinge spring 44 is attached beforehand is fastened to the a portion of the iron core 22 which is exposed from the upper end of the spool. As a result, the electromagnet block 2 assembly is completed.

In the finished electromagnet block 2, the movable iron piece 4 is supported in a turnable manner on the lower end of the yoke 41 by using the hinge spring 44. Under this condition, the first protruding portion 66 of the card member 65 which is integrally formed with the movable iron piece 4 can come into contact with the yoke 41, and the elastic contact portion 46 of the hinge spring 44 can move closer to and away from the second protruding portion 67 of the card member 65. Next, the electromagnet block 2 to which the movable iron piece 4 is attached, and the contact switching unit 3 is installed in the base 1.

When installing the electromagnet block 2, the coil terminal 36 is press-fitted into the coil terminal hole 11 of the base 1, and both side portions of the yoke 41 are inserted into the guide grooves 15 of the guide wall 13. In the installed state, the guide protrusion 35 is located in the supporting concave portion 10, and the electromagnet block 2 is positioned on one side thereof in the direction of YY'. Moreover, the lower end surface of the protruding portion 42 of the yoke 41 and the bottom surface of the terminal attachment portion 31 come in contact with the bottom surface of the recesses 9 of the base 1 respectively. As a result, a gap is formed between the bottom surface of the recess 9 of the base 1 and the bottom surface of the lower-end flange 29 of the spool 23, and the movable iron piece 4 is turnable in the gap. The shield wall 70 of the card member 65 which is integrally formed with the movable iron piece 4 is arranged over the insulation wall 14 of the base 1. At this time, the insulation performance between the electromagnet block 2 and the contact switching unit 3 is sufficiently secured due to the presence of the guide wall 13 and insulation wall 14 of the base 1, and an upper portion of the card member 65 and the shield wall 70.

When installing the contact switching unit 3, the press-fitted portion 58 of the movable contact piece 52 is press-fitted into the first terminal hole 18 of the base 1. When installing the movable contact piece 52, since the projection 61 is located in the communicating portion 19, the installation state of the movable contact piece 52 can be confirmed by viewing the bottom surface of the base 1. Moreover, the pressing portion 69 of the card member 65 which has been installed beforehand comes in pressure-contact with the upper end portion of the movable contact piece 52, and the movable iron piece 4 is positioned at the default position at which the to-be-attracted portion 63 is separated from the magnetic pole portion 25 of the iron core 22 due to the elastic force of the movable contact piece 52.

Moreover, the terminal portion 54 of the fixed contact piece 51 is inserted into the second terminal hole 21 of the base 1, and the press-fitted portion 53 is then press-fitted so as to be fixed. Under this condition, the lower edge of the press-fitted portion 53 comes in contact with the partially left bottom surface of the second contact hole 21, so that the dimension of a protruding portion of the terminal portion 54 which protrudes from the base 1 becomes a pre-set value. Moreover, the sealing agent reservoir 54*j* composed of a part of the inclined edge 54*g* and the L-shaped edge 54*h* which is connected to the inclined edge 54*g* is exposed from the lower surface of the base 1 due to the cut-away portions 54*i* formed in the terminal portion 54. As a result, even in a case in which the position of the opening of the second terminal hole 21 in the bottom surface of the base 1 is near the short side of the base 1, and thus a sufficient space cannot be secured, the sealing agent can be injected into the second terminal hole 21 via the sealing agent reservoir 54*j*. Moreover, the fixed contact piece 51 faces the movable contact piece 52 with a prescribed distance therebetween, and the movable contact 62 can move closer to or away from the fixed contact 57.

Moreover, the arc-extinguishing member 75 is installed in the case 5. When installing the arc-extinguishing member 75, in the state in which the permanent magnets 76 are attached to the opposing walls 78 of the joint member 77, the opposing walls 78 of the joint member 77, the permanent magnets 76, and the middle protruding portion 80 are inserted into the concave portions 72, respectively formed in the case 5.

Subsequently, the base 1 is encased in the case 5 in which the arc-extinguishing member 75 has been installed beforehand, and the fitting portion and then each of the terminal holes are sealed. In this case, in the second terminal hole 21 from which the terminal portion 54 of the fixed contact piece 51 protrudes, the sealing agent may be supplied to the sealing agent reservoir 54*j* as described above. The sealing agent supplied to the sealing agent reservoir 54*j* flows over a short distance along the inclined edge 54*g* so as to enter the second terminal hole 21, so that the sealing agent seals up a gap between the second terminal hole 21 and the terminal portion 54. Thus, since the sealing agent is injected from the sealing agent reservoir 54*j* exposed from the base 1, the second terminal hole 21 can be reliability filled with the sealing agent. Moreover, since the flow of the surplus sealing agent is blocked by a structure formed by the L-shaped edge 54*h* of the sealing agent reservoir 54*j*, the surplus sealing agent does not spread to a portion of the terminal portion 54 which protrudes from the lower surface of the base 1.

3. Operation

Next, the operation of the magnetic relay having the above-described structure will be described.

Under a condition in which the coil 24 is not energized and the electromagnet block 2 is demagnetized, the movable iron piece 4 is located at the default position at which the to-be-attracted portion 63 is separated from the magnetic pole portion 25 of the iron core 22 because the movable iron piece 4 causes the to-be-attracted portion 63 to turn about the fulcrum supported by the yoke 41 by using the elastic force of the movable contact piece 52. Therefore, the movable contact 62 maintains the open state in which the movable contact 62 is separated from the fixed contact 57.

Figure 9:
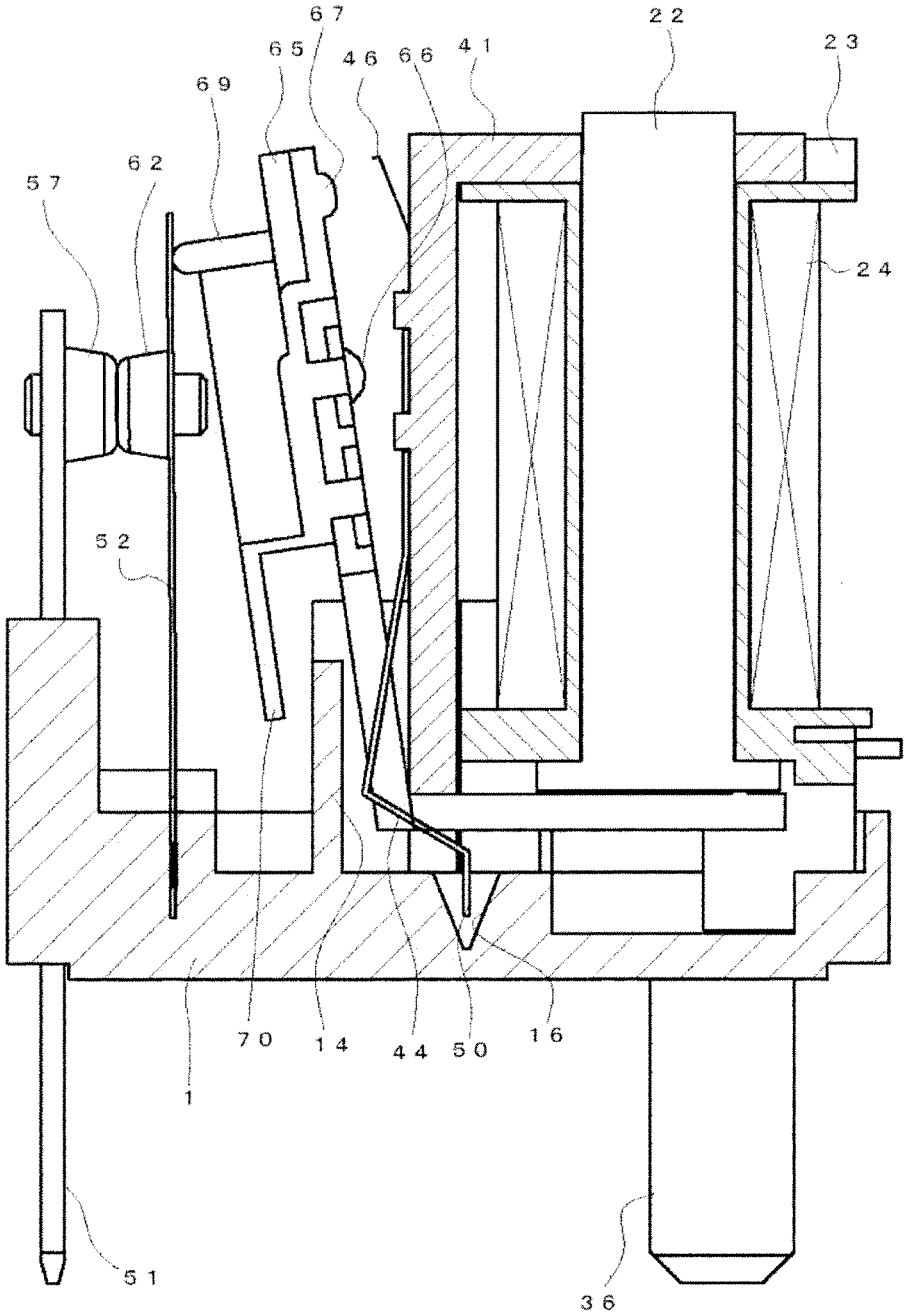
FIG. 9 is a cross-sectional view illustrating a state in which the case is removed from the structure of FIG. 1 when a relay contact is closed.
Figure 10:
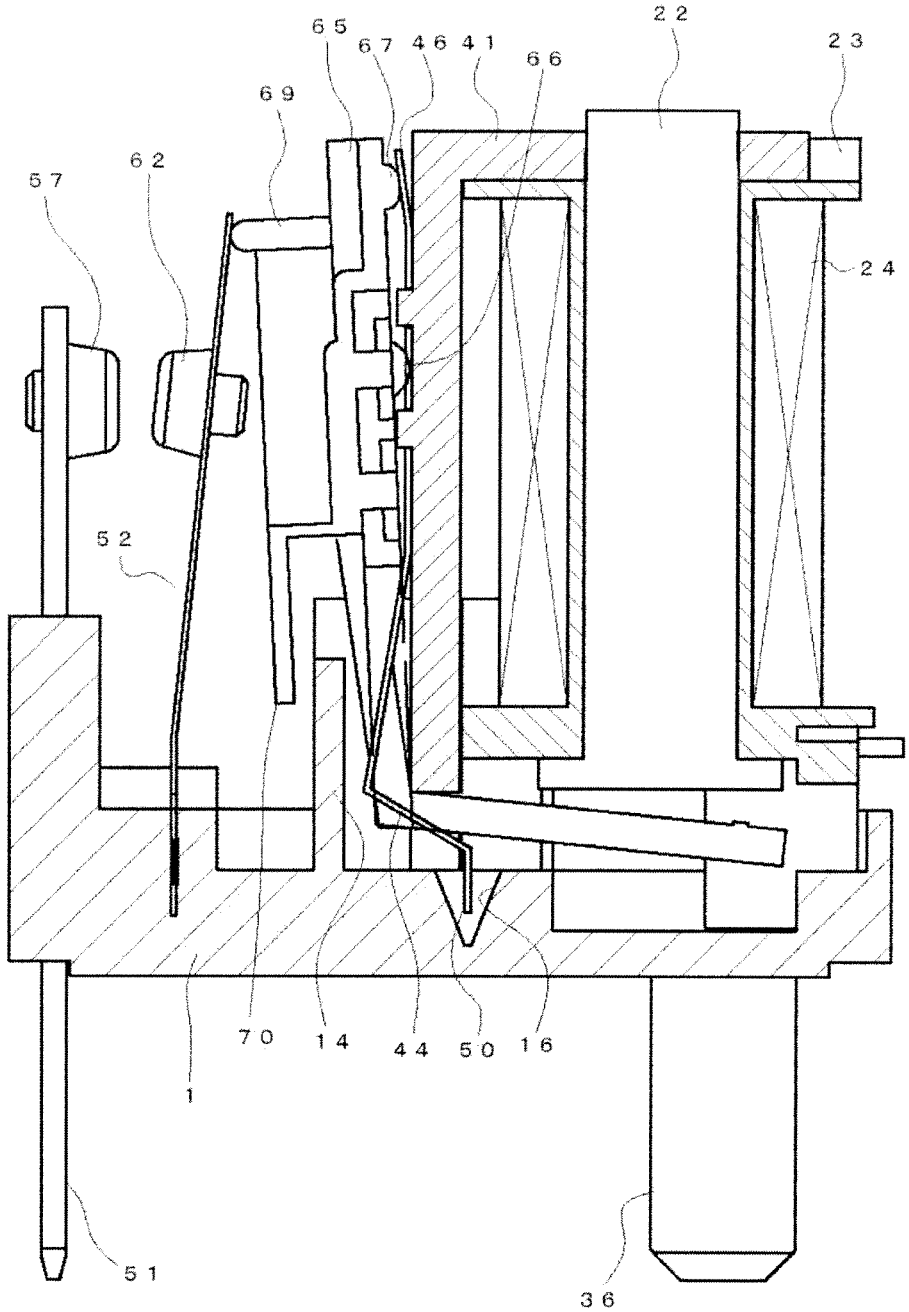
FIG. 10 is a cross-sectional view illustrating a state in which the case is removed from the structure of FIG. 1 when the contact is open.

When the coil 24 is energized and the electromagnet block 2 is excited, the to-be-attracted portion 63 of the movable iron piece 4 is attracted to the magnetic pole portion 25 of the iron core 22 and turns against the biasing force of the movable contact piece 52 as shown in FIG. 9. Such an operation allows the movable contact piece 52 to be elastically deformed and allows the movable contact 62 to be in contact with the fixed contact 57 of the fixed contact piece 51.

When energizing the coil 24 is stopped and the electromagnet block 2 is demagnetized, the movable iron piece 4 is not attracted by the iron core 22 anymore so that the movable iron piece 4 turns due to the elastomeric force of the movable contact piece 52. At this time, the second protruding portion 67 formed on the card member 65 of the movable iron piece 4 collides with the elastic contact portion 46 of the hinge spring 44. The second protruding portion 67 is made of a synthetic resin so that the elastic contact portion 46 is elastically deformed. However, a contact state of the second protruding portion 67 and the elastic contact portion 46 is obtained within a short time after the movable iron piece 4 starts turning. Accordingly, nearly no collision noise is generated. Then, as the movable iron piece 4 turns further, the elastic contact portion 46 is elastically deformed and the first protruding portion 66 made of a synthetic resin comes into contact with the middle portion of the yoke 41. Accordingly, the turning speed of the movable iron piece 4 is reduced, and this also serves to sufficiently suppress generation of the collision noise. In this way, the movable iron piece 4 smoothly returns to the default position without generating the collision noise and the movable contact 62 is separated from the fixed contact 57 and is positioned at an open position.

Incidentally, at the time when the contact is opened, an arc might occur between contact points. In this case, since the arc-extinguishing member 75 is arranged around a contact switching area, the generated arc is promptly extinguished.

That is, the magnetic flux generated from the N pole of each of the permanent magnets 76 runs in a magnetic circuit in which the magnetic flux passes the middle wall 79 via the middle protruding portions 80 of the joint member 77, and returns to the S pole of each of the permanent magnet 76 from the opposing walls 78. Each magnetic circuit forms a closed-loop so that nearly zero magnetic flux leaks to surroundings. Moreover, because of the presence of the middle protruding portion 80, the magnetism can be effectively exerted on the arc generated at the contact switching position, in other words, between the contacts points. As a result, the force is exerted on the generated arc in a direction orthogonal to the direction in which the contact is opened according to the Fleming's left hand rule, so that this arc is extended over a long distance. Therefore, the arc is rapidly extinguished.

Figure 11:
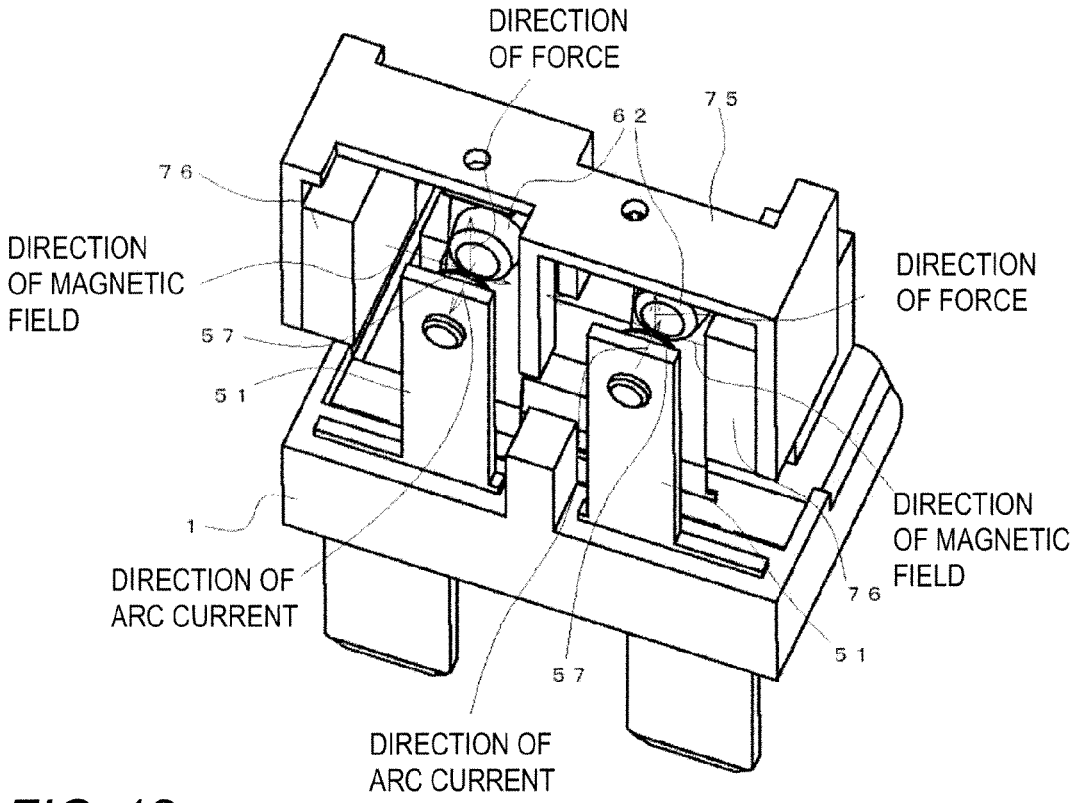
FIG. 11 is an enlarged perspective view of a contact switching unit of FIG. 3.

Here, since both the fixed contact pieces 51 are opened or closed by using the movable contact piece 52, the arc current flows in the direction shown in FIG. 11 at the time when the contacts are opened. Accordingly, the magnetic poles of the permanent magnets 76 are set in a manner that the magnetic poles of the opposing surfaces are different so that the direction of the magnetic flux which enables the arc to be deformed toward the middle wall of the joint member 77 can be obtained. That is, the arc can be more certainly extinguished because the arc is deformed toward the middle wall of the joint member 77. Therefore, if the contact switching unit 3 is differently structured from the above manner, the magnetic poles of the permanent magnets 76 may be set in a manner corresponding to such a structure.

Moreover, an operating voltage of the electromagnet block 2 can be adjusted as follows.

Figure 12:
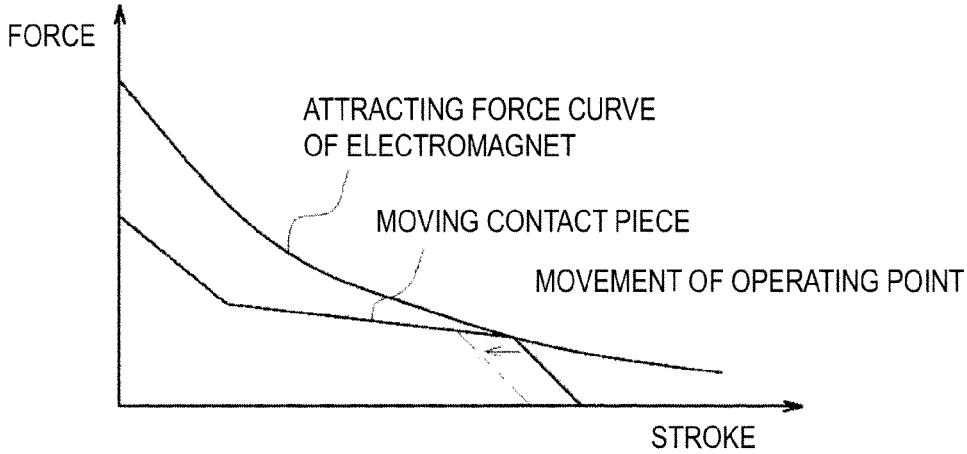
FIG. 12 is a graph illustrating an attracting force curve of the electromagnet block of FIG. 4 and illustrating a change in force exerting on a movable contact piece.

That is, the operating voltage of the electromagnet block 2 can be controlled by changing the inclination angle of the elastic contact portion 46 of the hinge spring 44. In greater detail, if the inclination angle of the elastic contact portion 46 with respect to the yoke 41 is increased, the position of an operating point can be changed in accordance with a change in the force (attracting force curve) that exerts on the to-be-attracted portion 63 of the movable iron piece 4 due to the magnetic field generated from the magnetic pole portion 25 of the iron core 22 as shown in the graph of FIG. 12. That is, the force needed for a period from the opening of the contacts to the timing at which the elastic contact portion 46 comes into contact with the first protruding portion 66 can be reduced by increasing the inclination angle of the elastic contact portion 46. Accordingly, the operating voltage of the electromagnet block 2 can be controlled such that the attracting force curve can change in a narrower range than that of FIG. 12.

The present invention is not limited to the structures described in the embodiment, and can be modified in various ways.

Figure 15A:
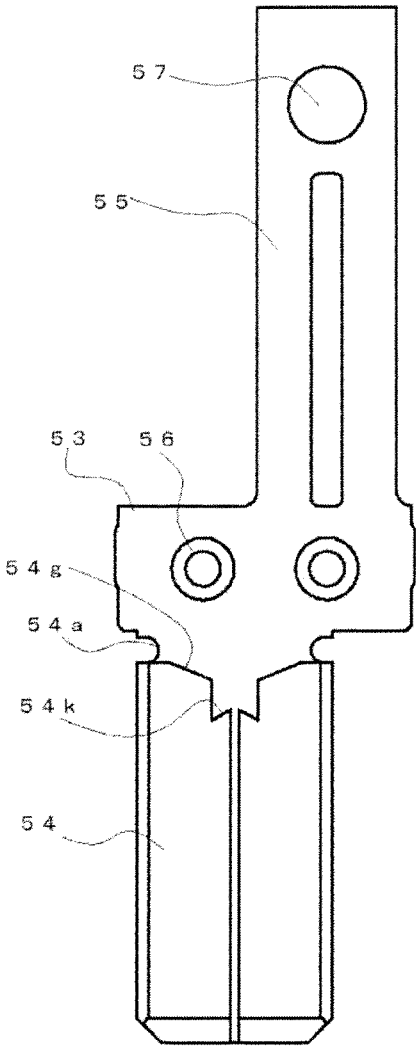
FIG. 15A and FIG. 15B are a front view illustrating a fixed contact piece according to another embodiment.

For example, although the sealing agent reservoir 54*j* is configured by the inclined edge 54*g* and the L-shaped edge 54*h* of the folded portions 54*d* in the above-described embodiment, the L-shaped edge 54*h* can be changed to a V-shaped edge 54*k* as shown in FIG. 15A so that the path that guides the sealing agent to the groove 54*e* can be increased. In this case, a problem that the sealing agent flows to positions other than the sealing position (mainly the second terminal hole 21) can be more adequately inhibited.

Moreover, the cut-away portion 54*i* can be formed to be broader in a corner portion of the L-shaped edge 54*h* or the V-shaped edge 54*k*. According to this structure, an event that the sealing agent flows to positions other than the sealing position can be much more adequately prevented.

Figure 15B:
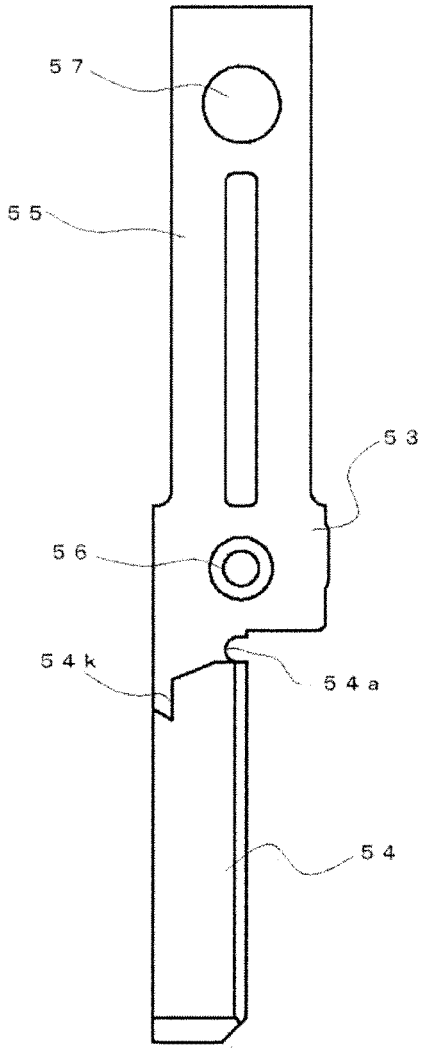

Moreover, even though the terminal portion 54 is formed such that the folded portions 54*d* are folded from both sides in the above-described embodiment, the folded portions 54*d* are not necessarily folded from both sides. That is, as illustrated in FIG. 15B, the terminal portion may have a structure having only one folded portion which is folded over from one side.

Moreover, even though the above-described embodiment discloses an example in which the sealing structure of a terminal member according to the present invention is adopted in an electromagnetic relay, the sealing structure of a terminal member according to the present invention can be adopted not only in the electromagnetic relay but also in other electronic devices, for example, a switch as long as the electronic devices include an electric switch.

There has thus been shown and described a novel sealing structure of a terminal member using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A sealing structure of a terminal member to be press-fitted in a terminal hole of a base, wherein the terminal member includes a press-fitted portion to be press-fitted in the terminal hole;

a terminal portion extending from the press-fitted portion and for protruding from the base and a sealing agent reservoir, wherein the terminal portion is configured by a folded plate-like body such that folded portions overlap a planar portion, at least one of the folded portions having a cut-away portion for extending from the base, at an edge near the press-fitted portion, and configured for a sealing agent to be injected into the terminal hole via the at least one cut-away portion, wherein the sealing agent reservoir is configured to store and solidify the sealing agent.

2. The sealing structure of a terminal member according to claim 1, wherein the terminal portion has a structure in which both sides of the plate-like body are folded such that the folded portions overlap the planar portion, and the folded portions have respective cut-away portions at opposing sides thereof, respectively.

3. The sealing structure of a terminal member according to claim 1, wherein each cut-away portion has an inclined edge which unites a portion for extending from the base to an inner side of the terminal hole.

4. The sealing structure of a terminal member according to claim 3, wherein the at least one cut-away portion is formed by cutting away opposing portions of both the folded portions in the portion extending from the base so that the cut-away portions and the planar portion forming the sealing agent reservoir.

5. The sealing structure of a terminal member according to claim 4, wherein among portions of the at least one cut-away portion, portions that form the sealing agent reservoir are partially broader than the other portions.

6. The sealing structure of a terminal member according to claim 1, wherein the terminal member further includes a contact piece portion for protruding from a side of the base opposite to a side from which the terminal portion protrudes, the contact piece portion having a contact at a leading end thereof and being elastically deformable.

7. An electromagnetic relay comprising:

a fixed contact piece having the sealing structure according to claim 1.

* * * * *